US009624013B2

(12) United States Patent
Sebben et al.

(10) Patent No.: US 9,624,013 B2
(45) Date of Patent: Apr. 18, 2017

(54) PACKAGING CONTAINER WITH PRESSURE RELIEF VALVE

(71) Applicant: Jofund S/A, Joinville-Santa Catarina (BR)

(72) Inventors: Marcos Alexandre Boettcher Sebben, Joinville-Santa Catarina (BR); Frederico Prates Vericimo, Joinville-Santa Catarina (BR)

(73) Assignee: JOFUND S/A, Joinville-Santa Catarina (BR)

( * ) Notice: Subject to any disclaimer, the term of this patent is extended or adjusted under 35 U.S.C. 154(b) by 23 days.

(21) Appl. No.: 14/705,935

(22) Filed: May 6, 2015

(65) Prior Publication Data

US 2016/0288966 A1 Oct. 6, 2016

(30) Foreign Application Priority Data

Apr. 1, 2015 (BR) ..... 1020150073984

(51) Int. Cl.

| | |
|---|---|
| ***B65D 51/16*** | (2006.01) |
| ***B65D 43/02*** | (2006.01) |
| ***B65D 21/02*** | (2006.01) |
| ***B65D 41/16*** | (2006.01) |
| ***B65D 51/28*** | (2006.01) |

(52) U.S. Cl.

CPC ..... *B65D 51/1644* (2013.01); *B65D 21/0222* (2013.01); *B65D 41/165* (2013.01); *B65D 43/0222* (2013.01); *B65D 51/1683* (2013.01); *B65D 51/28* (2013.01); *B65D 2543/00092* (2013.01); *B65D 2543/00398* (2013.01); *B65D 2543/00537* (2013.01); *B65D 2585/6882* (2013.01)

(58) Field of Classification Search

CPC .. B65D 51/1644; B65D 41/165; B65D 51/28; B65D 21/0222

USPC ..... 220/203.1, 203.16, 203.13, 203.11, 202, 220/203.01, 203.09

See application file for complete search history.

(56) References Cited

U.S. PATENT DOCUMENTS

| | | | | |
|---|---|---|---|---|
| 5,779,082 A * | 7/1998 | Miramon | B65B 31/047 141/64 |
| 2004/0040618 A1* | 3/2004 | Vilalta | B65B 31/047 141/65 |
| 2004/0040961 A1* | 3/2004 | Vilalta | B65D 51/1683 220/212 |
| 2005/0061812 A1* | 3/2005 | Vilalta | B65D 51/1683 220/212 |
| 2007/0284276 A1* | 12/2007 | Luttik | B65D 21/022 206/508 |

* cited by examiner

*Primary Examiner* — Robert J Hicks
*Assistant Examiner* — Kareen Thomas

(57) ABSTRACT

The present invention relates to a packaging container (E) comprising a base (2) closed by an overlapping cover (1) used for the storage of automotive parts, particularly, brake discs and/or brake drums, clutch discs, wheel hubs or any other parts with similar shapes for motor vehicles, package (E) being provided with structural ribs (3 and 33) and at least one opening (4), which is sealed by a pressure relief valve (5). Said pressure relief valve (5) comprises a connecting base (50) provided with an opening (500) and a closure lid (51) provided with locking and sealing means (510), which are joined to one another in an articulated way.

14 Claims, 3 Drawing Sheets

PACKAGING CONTAINER WITH PRESSURE RELIEF VALVE

The present invention relates to a packaging container with at least one pressure relief valve, said packaging container being used for the storage of automotive parts, particularly, brake discs and/or brake drums, clutch discs, wheel hubs, or any other parts with similar shapes for motor vehicles, whose main objective is to facilitate repeatedly opening and closing of a cover by means of a pressure relief valve without damaging said container and valve. Said packaging container further comprises particular and specific structural characteristics to enable the amount of material used to be reduced while keeping desired mechanical strength.

BACKGROUND OF THE INVENTION

Packaging containers, generally manufactured in plastic, used to store automotive parts such as brake discs and/or brake drums, and clutch discs, are known in the state of the art, mainly for protection against external agents, contact with other objects and to facilitate transport, as such automotive components are comprised by high density materials, thus resulting in heavy parts, which exert a lot of force against the walls of their packages. They should, therefore, provide enough mechanical strength to withstand transport and stacking of packages.

Such packaging containers basically comprise a base for packing an automotive component, which is closed by a cover easily opened by the user for checking information related to the product, such as model and size, said procedure being quite common before packing the component.

Such packaging containers comprise at least one opening, closed or not by a suitable adhesive, which can be broken by the user to relieve air pressure, thus allowing opening and closing of package, as involuntary movements of cover are blocked by said adhesive.

Among the developed packaging container models, the one included in Brazilian patent document MU7701997-0, filed on Jul. 31, 1997, originally titled "Arrangement applied to packaging assembly for brake discs" can be mentioned, which discloses a packaging container provided with a cover with at least one opening to help relieve air pressure when opening and closing the package. Disadvantageously, though, said opening is not provided with any protection, such as, for example, a seal and, thus, the inside of package is prone to receive solid, liquid and gas residues that may damage or deteriorate the product, thus leading to irretrievable loss thereof.

Another well-known packaging container model for brake discs and/or brake drums, clutch discs or wheel hubs also comprises an opening, which is closed by a seal directly taped to the top of opening. Thus, to open package, the user simply removes the seal from the opening and blows/injects air into the package.

Disadvantageously, though, cover on said package can only be opened a few times as the seal responsible for sealing the air pressure relief opening is glued to the package cover. Thus, repeatedly removing and reattaching the seal wears out the glue and, eventually, its effectiveness is lost leaving the opening unprotected and the cover vulnerable.

Brazilian Patent document MU8201883-9, filed on Aug. 9, 2002, originally titled "Arrangement applied to packaging assembly" can be further mentioned, which discloses a packaging container provided with a sidelong seal which enables air to come into the package when the seal is broken thus allowing the package cover to be opened in a suitable way. Disadvantageously, though, said cover package can only be opened once, as once the seal is broken, it is no longer possible to seal it again.

Another drawback of current packaging containers is the lack of structural elements to provide greater mechanical strength thereof. Thus, a large amount of material is required to manufacture each package so as to provide them with the required mechanical strength to withstand the automotive parts placed inside thereto.

Aiming to solve the above mentioned problems, the present invention proposes a packaging container with a pressure relief valve for storing automotive parts, being possible for said pressure relief valve to be opened and closed as many times as necessary, so as to prevent the cover from being moved in an involuntary way, but allowing it to be opened whenever it is required by the user, without restrictions as to the number of repetitions.

Another object of the present invention is a packaging container with a pressure relief valve which is provided with structural elements which are capable of delivering greater mechanical strength to package, even with a reduced amount of material used.

In addition, the structural elements arranged on the package provide compartments that can be used by the user to store, in an organized way, screws, nuts and other objects used for assembling automotive parts in a vehicle, when the package is opened and the parts are to be used.

Advantageously, packaging container presents particular and specific structural characteristics that enable the amount of material used to be reduced while keeping desired mechanical strength, and with at least one pressure relief valve, to store automotive parts in a practical and safe manner, thus allowing the user to open and close the package cover several times without damaging said package and valve.

BRIEF DESCRIPTION OF THE INVENTION

Briefly, the present invention discloses a packaging container comprising a base closed by an overlapping cover for the purpose of storing automotive parts, package being provided with structural ribs arranged on at least one of its flat surfaces, and at least one opening, which is, preferably, circular shaped and sealed by a pressure relief valve. The pressure relief valve comprises a connecting base and a closure lid joined to one another in an articulated way.

Said connecting base of pressure relief valve is provided with an opening and suitable locking and sealing means to be fitted by interference fit into the package opening so that the air goes through the openings only when said lid is opened. Said locking and sealing means are made up by an annular extension provided with an annular protrusion in the shape of an arrow to make it easier to fit and to make it difficult to disengage from the opening. Said pressure relief valve lid is provided with locking and sealing means for the opening of the pressure relief valve connecting base. When the lid is closed, its locking and sealing means are fitted into the connecting base, thus preventing air from going through the opening and into the inside of package.

Structural ribs can be formed in at least one of the flat surfaces of cover and/or base comprising said package. Said structural ribs are arranged crosswise, in general in parallel and interconnected by a median ridge, and delimited at their ends by an annular structural rib.

Thus, said structural ribs enable the reduction of material used while keeping the desired mechanical strength, and form compartments suitable for storing small objects, such as nuts, screws, washers and the similar. When package is disassembled for the use of the automotive parts on its inside, the package cover is used as a tray.

Schematic figures of a particular embodiment of the invention are presented below, in which the dimensions and proportions are not necessarily the actual values since the sole purpose of the figures is to present in a didactic manner the various aspects of the invention, the extent of protection of which is determined exclusively by the scope of the annexed claims.

DESCRIPTION OF THE INVENTION

Figure 1:
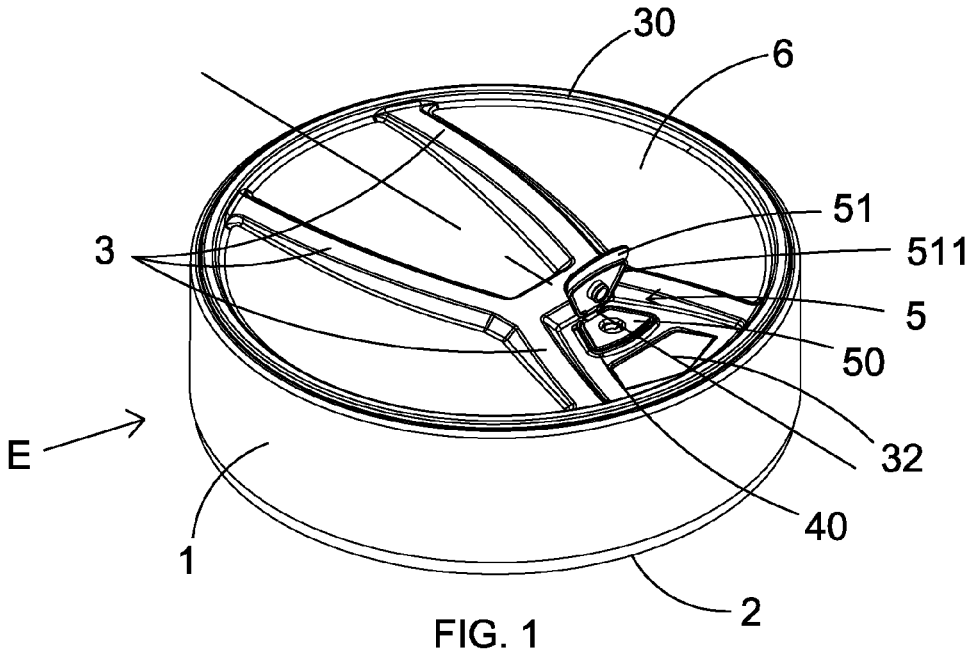
FIG. 1 is a perspective view of a package (E) with the closure lid (51) of the pressure relief valve (5) in the open position.
Figure 3:
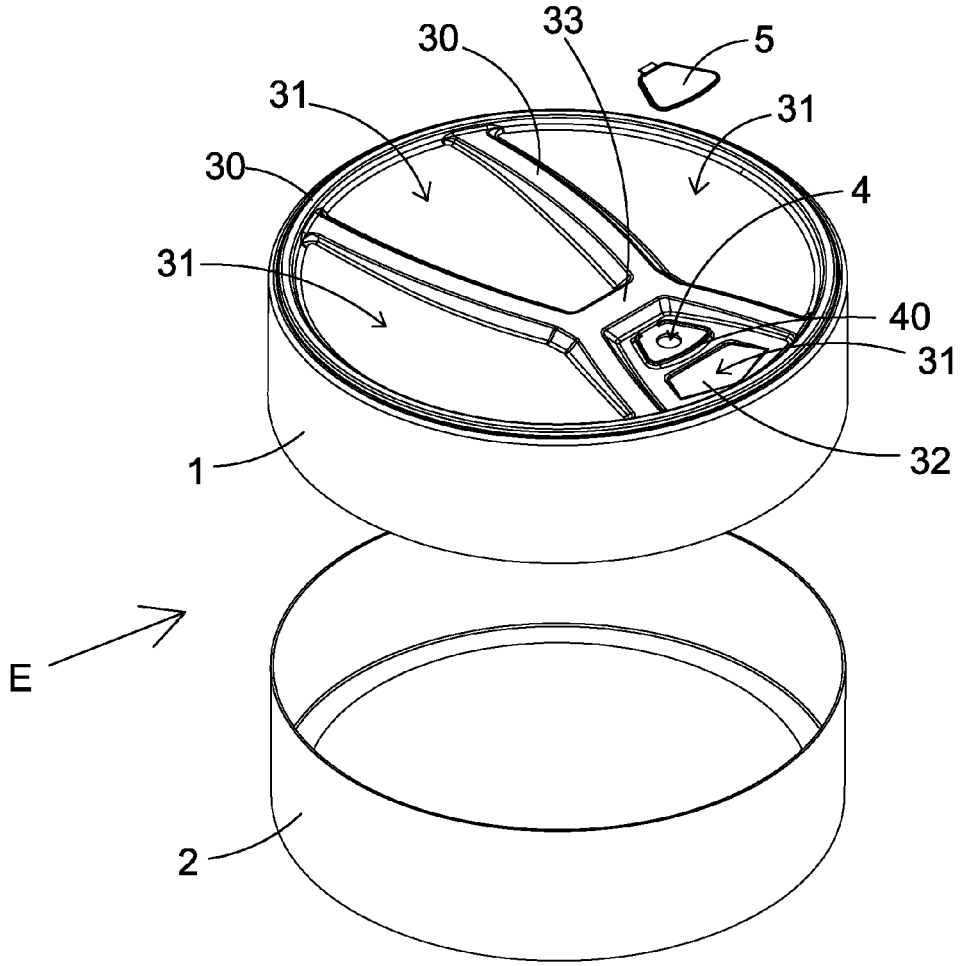
FIG. 3 is an exploded view of a package (E)

According to FIGS. 1 and 3, package (E) comprises a base (2) closed by an overlapping cover (1) and used to store at least one automotive part, package (E) being provided with structural ribs (3 and 33) arranged in at least one of its flat surfaces (6 and 7), and at least one opening (4), which is, preferably, circular shaped and sealed by a pressure relief valve (5). Said cover (1) is fitted in the base (2) so that the air is expelled from the inside of package (E), an action which generates a negative pressure inside thereto and prevents the cover (1) from being removed until an amount of air is blown/injected into the package (E) through the pressure relief valve (5).

Figure 4:
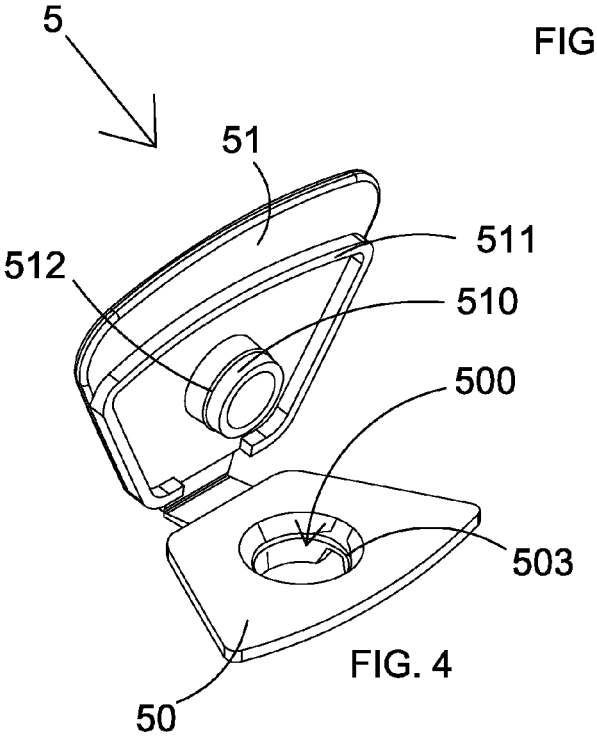
FIG. 4 is a perspective view of the pressure relief valve (5) with its closure lid (51) in the open position.
Figure 5:
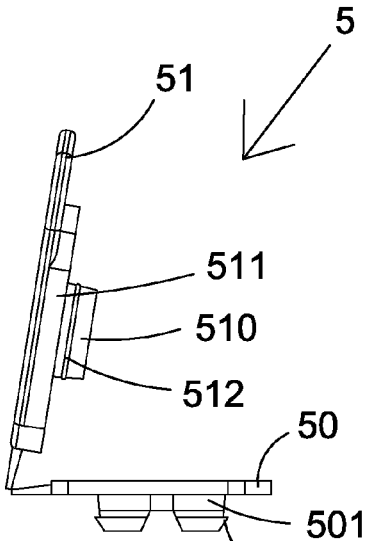
FIG. 5 is a side view of the pressure relief valve (5) with its closure lid (51) in the open position.

As illustrated in FIGS. 4 and 5, said pressure relief valve (5) comprises a connecting base (50) and a closure lid (51). Preferably, said connecting base (50) and closure lid (51) are joined to one another in an articulated way.

Said connecting base (50) of pressure relief valve (5) is provided with an opening (500) and locking and sealing means (501) suitable to be fitted by interference fit into the package (E) opening (4) so that the air goes through the openings (4 and 500) only when said closure lid (51) is opened. Thus, preferably, said locking and sealing means (501) have a shape consistent with said opening (4) and an external geometry minimally smaller than the internal geometry of said opening (4).

Still preferably, as illustrated in FIG. 5, said locking and sealing means (501) are made up by an annular extension and provided with an annular protrusion (502) in the shape of an arrow to make it easier to fit and make it difficult to disengage from the opening (4).

Said closure lid (51) of the pressure relief valve (5) is provided with locking and sealing means (510) for closing the opening (500), preferably in a shape consistent with said opening (500) and an external geometry minimally smaller than the internal geometry of said opening (500) of pressure relief valve (5) connecting base (50). When said closure lid (51) is closed, its locking and sealing means (510) are fitted into the connecting base (50), thus preventing the air from getting into the package (E) through the opening (4).

Preferably, as illustrated in FIG. 4, said locking and sealing means (510) are provided with an extension (512), while opening (500) of the connecting base (50) is provided with an extension (503), both extensions (503 and 512) being conveniently designed so as to result in a snap-like effect during their contact. When the closure lid (51) is closed onto the connecting base (50), said extension (512) of the locking and sealing means (510) is placed under the extension (503) of the opening (500), thus making it difficult to open, even involuntarily, the closure lid (51) of the pressure relief valve (5).

Optionally, connecting base (50) can be fixed to at least one of the flat surfaces (6 and 7) by means of a fusion or gluing process, or a similar process, so as to join the connecting base lower surface (50) to at least one of the package (E) surfaces (6 and 7).

Still preferably, as illustrated in FIG. 4, said closure lid (51) of pressure relief valve (5) further comprises a projection (511) on the cover profile in a shape which is consistent with the connecting base (5) and with an internal geometry minimally smaller than the external geometry of the connecting base (50) of the pressure relief valve (5). When the closure lid (51) is closed onto the connecting base (50), said projection (511) fits said connecting base (50), thus making said closure lid (51) more stable as it limits its sideways movement in relation to the connecting base (50) and makes it difficult to be involuntarily opened while helps sealing it by preventing air from getting inside the package (E) through the opening (4).

Preferably, as illustrated in FIGS. 1 and 3, said package (E) is further provided with a projection (40) on the cover profile in a shape which is consistent with the projection (511) and with an internal geometry minimally larger than the external geometry of the projection (511), and which limits the sideways movement of the entire pressure relief valve (5) in relation to the package (E) cover (1), thus preventing removal and/or involuntary opening of said pressure relief valve (5).

When closure lid (51) of pressure relief valve (5) is in the closed position (see FIG. 2), the negative pressure inside the closed package (E) prevents the cover (1) from being removed from the base (2), thus ensuring safe storage of automotive parts inside the package (E). Similarly, when the closure lid (51) of pressure relief valve (5) is in the open position (see FIG. 1), the user simply blows/injects air into the package (E) through the pressure relief valve (5) to easily remove the cover (1) from the base (2).

To close package (E) again, simply fit the cover (1) over the base (2) with the pressure relief valve (5) in the open position so as to remove the air from the inside of package (E) and generate a negative pressure in its inside and, then, close the closure lid (51) of pressure relief valve (5). Package (E) cover (1) can be opened several times without restrictions as to the number of times this procedure is repeated.

Figure 2:
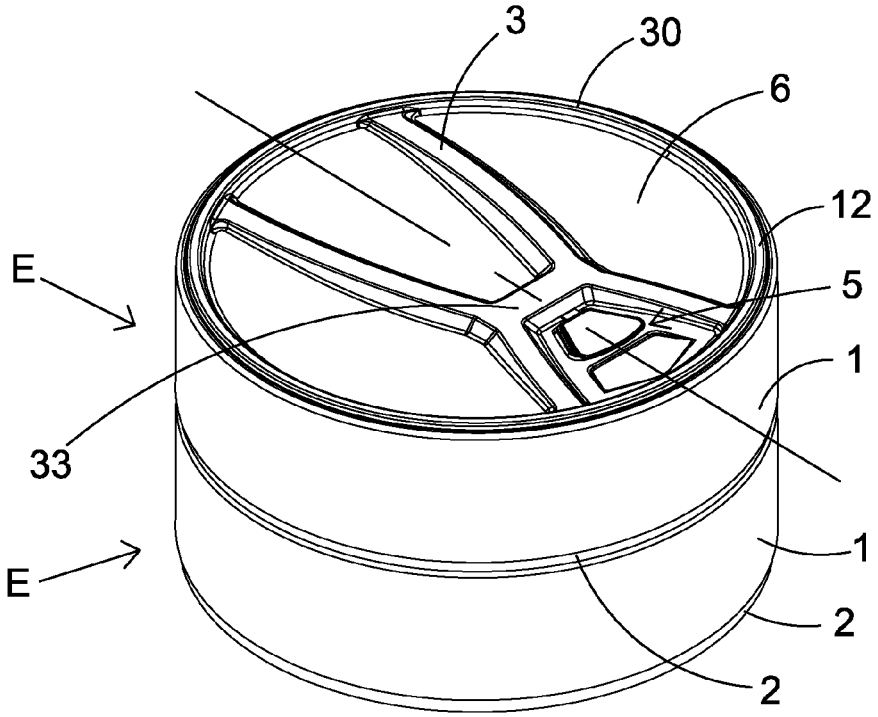
FIG. 2 is a perspective view of two packages (E) stacked on top of each other.

As illustrated in FIGS. 1 and 2, structural ribs (3) can be formed on at least one of the flat surfaces (6 and 7) of cover (1) and/or base (2) comprising said package (E). Said structural ribs (3) are arranged crosswise, in general in parallel and interconnected by a median rib (33), and delimited at their ends by an annular structural rib (30). Advantageously, said structural ribs (3 and 33) enable material to be reduced while keeping the desired mechanical strength.

Said structural ribs (3 and 33) then form suitable compartments (31) for the storage of small objects (not illustrated), such as nuts, screws, washers and the similar.

When the package (E) is disassembled for the use of the automotive parts on its inside, the package (E) cover (1) is used as a tray and the user can separate the fixing components and/or other objects (not illustrated) to be used during installation of automotive parts into its referred compartments (31).

Preferably, as illustrated in FIG. 3, package (E) further comprises a recess (32) arranged in an area close to the opening (4) to provide greater structural strength thereto and to form a stand-out area in which the user can easily notice the position of the pressure relief valve (5).

In a particular embodiment of the present invention, said structural ribs (3 and 33) form four compartments (31) on the cover (1). It will be understood, though, that ribs (3 and 33) can be arranged and interconnected in such a way as to form any number of compartments (31) without departing from the extent of protection of the present invention.

Figure 6:
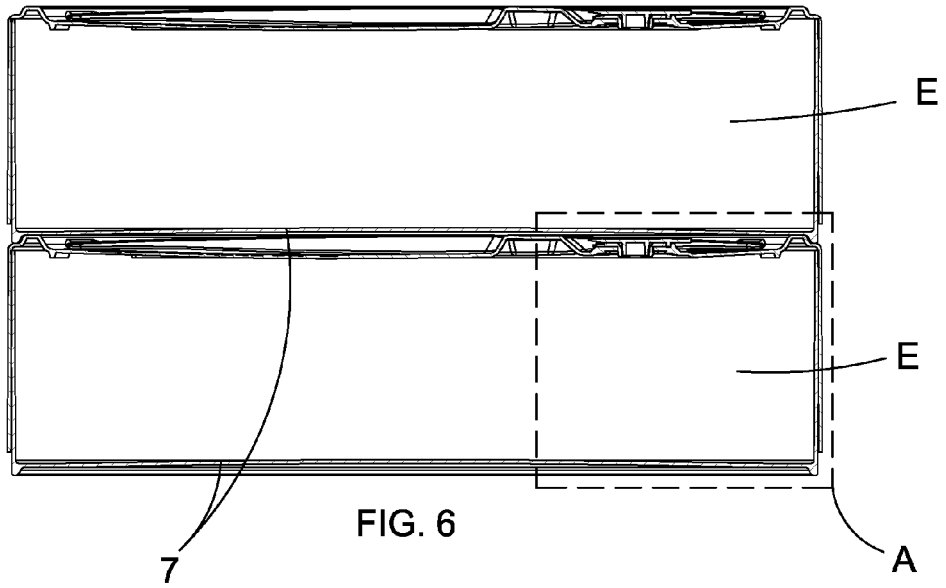
FIG. 6 is a cross-section view of two packages (E) stacked on top of each other.
Figure 6A:
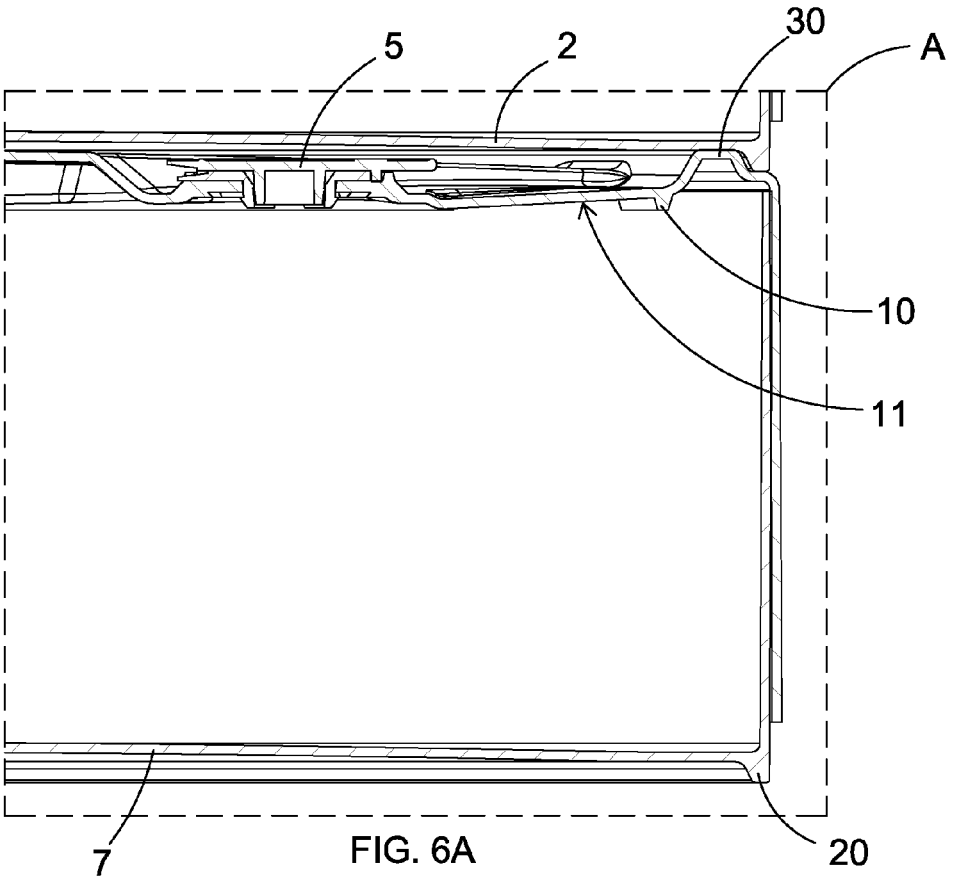
FIG. 6A is an expanded view of detail "A" of FIG. 6.

Optionally, as illustrated in FIG. 6A, cover (1) is provided with at least one annular extension (10), which is arranged on the inner lower surface (11) of said cover (1). Thus, when at least two packages (E) are stacked, the weight exerted by one package (E) on the other is considerably absorbed by said annular extension (10) of the package (E) positioned underneath, its annular extension (10) being supported on the part included inside this package (E), thus avoiding physical deformations thereto.

Said package (E) is further provided with anchoring and stacking means defined from the cooperative fitting between the annular structural rib (30) arranged on said cover (1) and a second annular extension (20) arranged on the base (2) lower portion. Therefore, one among said ribs (30) or extensions (20) has a size which is minimally smaller than the other, while their shapes are consistent with each other, thus allowing a safe stacking of two or more packages (E), as illustrated in FIGS. 2, 6 and 6A, and preventing residues and other objects from getting inside said stacked packages (E).

Variations and modifications with respect to the embodiments shown and described in the attached drawings will readily occur to a person skilled in the art without departing from the scope of the present invention as defined in the claims.

The invention claimed is:

1. Packaging container with pressure relief valve, package (E) comprising a base (2) closed by an overlapping cover (1), said package being provided with structural ribs (3) and at least one opening (4), characterized in that said package (E) comprises at least one pressure relief valve (5) formed by a connecting base (50) with an opening (500) and a closure lid (51) with locking and sealing means (510); the connecting base (50) is conveniently fixed to at least one of flat surfaces (6 and 7) of the cover (1) or the base (2) forming the package (E) so that the opening (500) of the connecting base (50) is arranged concentrically the at least one opening (4) of said package (E); the locking and sealing means (510) are fitted by interference fit into the opening (500) of connecting base (50);

wherein, in the at least one of flat surfaces (6 and 7), the at least one of structural ribs (3) are arranged crosswise, in general in parallel and delimited at ends by an annular structural rib (30).

2. Packaging container with pressure relief valve according to claim 1, characterized in that the connecting base (50) comprises the locking and sealing means (510) made up by an annular extension with a shape consistent with the at least one opening (4) and with an external geometry minimally smaller that an internal geometry of the at least one opening (4) so that the annular extension can be fitted and sealed into the at least one opening opening (4).

3. Packaging container with pressure relief valve according to claim 1, characterized in that the locking and sealing means (510) have a shape consistent with the opening (500) on the connecting base (50) and an external geometry minimally smaller than an internal geometry of the opening (500) on the connecting base (50).

4. Packaging container with pressure relief valve according to claim 3, characterized in that the locking and sealing means (510) are provided with an extension (512) and the opening (500) on the connecting base (50) is provided with an extension (503) resulting in a snap-fit effect between the extensions (503 and 512) during their contact.

5. Packaging container with pressure relief valve according to claim 1, characterized in that the connecting base (50) and the closure lid (51) are joined to one another in an articulated way.

6. Packaging container with pressure relief valve according to claim 1, characterized in that the locking and sealing means (501) are provided with an annular protrusion (502) with an arrow shape.

7. Packaging container with pressure relief valve according to claim 1, characterized in that the closure lid (51) comprises a first projection (511) on the cover profile with a shape consistent and an internal geometry minimally larger than an external geometry of the connecting base (50).

8. Packaging container with pressure relief valve according to claim 7, characterized in that said package (E) further comprises a second projection (40) on the cover profile with a shape of the second projection (40) consistent with the first projection (511) and an internal geometry minimally larger than the external geometry of the first projection (511).

9. Packaging container with pressure relief valve according to claim 1, characterized in that the connecting base (50) is fixed to at least one of flat surfaces (6 and 7) by means of a fusion or gluing process, so as to join said connecting base (50) lower surface to at least one of the package (E) surfaces (6 and 7).

10. Packaging container with pressure relief valve according to claim 1, characterized in that the structural ribs (3) are interconnected by a median rib (33).

11. Packaging container with pressure relief valve according to claim 10, characterized in that the structural ribs (3 and 33) form compartments (31) for storing small objects.

12. Packaging container with pressure relief valve according to claim 1, characterized in that the package (E) further comprises a recess (32) arranged in an area close to the opening (4).

13. Packaging container with pressure relief valve according to claim 1, wherein the cover (1) has at least one annular extension (10) arranged on an inner lower surface (11) of the cover (1).

14. Packaging container with pressure relief valve according to claim 1, characterized in that the package (E) further comprises anchoring and stacking means defined from the cooperative fitting between the annular structural rib (30) arranged on said cover (1) and an annular extension (20) arranged on the base (2) lower portion.

* * * * *